US008899701B2

(12) United States Patent
Walker

(10) Patent No.: US 8,899,701 B2
(45) Date of Patent: Dec. 2, 2014

(54) S-BOX STORAGE UNIT

(75) Inventor: Elaine Claire Walker, Leeds (GB)

(73) Assignee: Cardinal IP Limited, Shipley, Bradford (GB)

( * ) Notice: Subject to any disclaimer, the term of this patent is extended or adjusted under 35 U.S.C. 154(b) by 165 days.

(21) Appl. No.: 12/679,163

(22) PCT Filed: Sep. 19, 2008

(86) PCT No.: PCT/GB2008/050841

§ 371 (c)(1),
(2), (4) Date: Jun. 18, 2010

(87) PCT Pub. No.: WO2009/037507

PCT Pub. Date: Mar. 26, 2009

(65) Prior Publication Data

US 2010/0301715 A1 Dec. 2, 2010

(30) Foreign Application Priority Data

Sep. 19, 2007 (GB) ..... 0718337.9

(51) Int. Cl.

| | |
|---|---|
| ***A47B 51/00*** | (2006.01) |
| ***A47B 57/00*** | (2006.01) |
| ***A47B 95/02*** | (2006.01) |
| ***A47B 95/00*** | (2006.01) |
| ***A47B 77/08*** | (2006.01) |

(52) U.S. Cl.

CPC ..... *A47B 77/08* (2013.01); *A47B 2220/0013* (2013.01)

USPC ..... 312/312; 312/319.4; 312/306

(58) Field of Classification Search

USPC ..... 312/312, 306, 319.4, 319.5–319.8, 7.2, 312/247, 246, 242

See application file for complete search history.

(56) References Cited

U.S. PATENT DOCUMENTS

| | | | | | |
|---|---|---|---|---|---|
| 477,509 | A | * | 6/1892 | Chase | 312/312 |
| 628,828 | A | * | 7/1899 | Mentzer | 312/247 |
| 835,157 | A | * | 11/1906 | Fry | 312/247 |
| 1,003,253 | A | * | 9/1911 | Hallett | 312/247 |

(Continued)

FOREIGN PATENT DOCUMENTS

| | | | | |
|---|---|---|---|---|
| CH | 264251 | A | 10/1949 | |
| CH | 665537 | A5 | 5/1988 | |
| JP | H09309680 | A * | 12/1997 | B66B 13/06 |
| WO | WO2007054132 | | 5/2007 | |

OTHER PUBLICATIONS

International Search Report dated Feb. 16, 2009 in International Application No. PCT/GB2008/050841.

*Primary Examiner* — Janet M Wilkens
*Assistant Examiner* — Andrew Roersma
(74) *Attorney, Agent, or Firm* — Downs Rachlin Martin PLLC

(57) ABSTRACT

A household item (12), such as a microwave oven, can be moved from a lowered storage position to a raised usable position. In the storage position the moving surface lid (14) is flat with the surrounding work surface (10) having been lowered by a manual force and held in place by a suitable catch or latching mechanism. The household item can be raised by pushing the housing slightly downwards, thus releasing the housing from its anchored position. A counterweight (15) greater than the weight of the household item is suspended by way of a wire and pulley system (1*a*, 1*b*, 1*c*) that in turn powers the platform and displaces the lid, on which the household item is located, upwardly.

17 Claims, 8 Drawing Sheets

(56) References Cited

U.S. PATENT DOCUMENTS

| | | | | | |
|---|---|---|---|---|---|
| 1,623,674 | A | * | 4/1927 | Hagestedt | 109/17 |
| 3,067,700 | A | * | 12/1962 | O'Meara et al. | 109/12 |
| 3,245,741 | A | | 4/1966 | Bartlett | |
| 3,650,591 | A | * | 3/1972 | Longmire, Sr. | 312/312 |
| 3,932,009 | A | * | 1/1976 | Zollinger | 312/312 |
| 3,997,028 | A | | 12/1976 | Lopez | |
| 4,065,194 | A | * | 12/1977 | Mattia | 312/247 |
| 4,700,993 | A | * | 10/1987 | Fu-Long | 312/312 |
| 5,401,089 | A | * | 3/1995 | Inagaki et al. | 312/7.2 |
| 5,797,666 | A | | 8/1998 | Park | |
| 5,860,371 | A | * | 1/1999 | Shelley | 109/11 |
| 6,733,094 | B1 | * | 5/2004 | Chang | 312/7.2 |
| 6,755,492 | B1 | * | 6/2004 | Hyde et al. | 312/247 |
| 2003/0205951 | A1 | * | 11/2003 | Lambert | 312/7.2 |
| 2005/0057129 | A1 | * | 3/2005 | Bober | 312/312 |
| 2006/0076860 | A1 | * | 4/2006 | Hoss | 312/312 |
| 2006/0185563 | A1 | * | 8/2006 | Sweere et al. | 108/28 |

* cited by examiner

S-BOX STORAGE UNIT

The present invention relates to an indoor or outdoor storage unit and a method of operating such a storage unit.

Kitchens, bathrooms and offices within domestic and commercial properties are generally restricted by the space they can occupy due to construction design. Thereafter in the modern world we have an ever increasing amount of new products coming onto the market that are specifically designed for use within those environments. Consequently, home owners and commercial property users alike have to make a choice between which products or items of equipment they have out on display and ready for use, as opposed to concealing them within storage cupboard or units.

It is the objective of the present invention to attempt to overcome at least one of the above and or other disadvantages.

The present invention is defined in the claims.

The present invention can be carried into practice in various ways but the primary embodiment will now be described by way of example and with reference to the accompanying drawings.

Figure 4A:
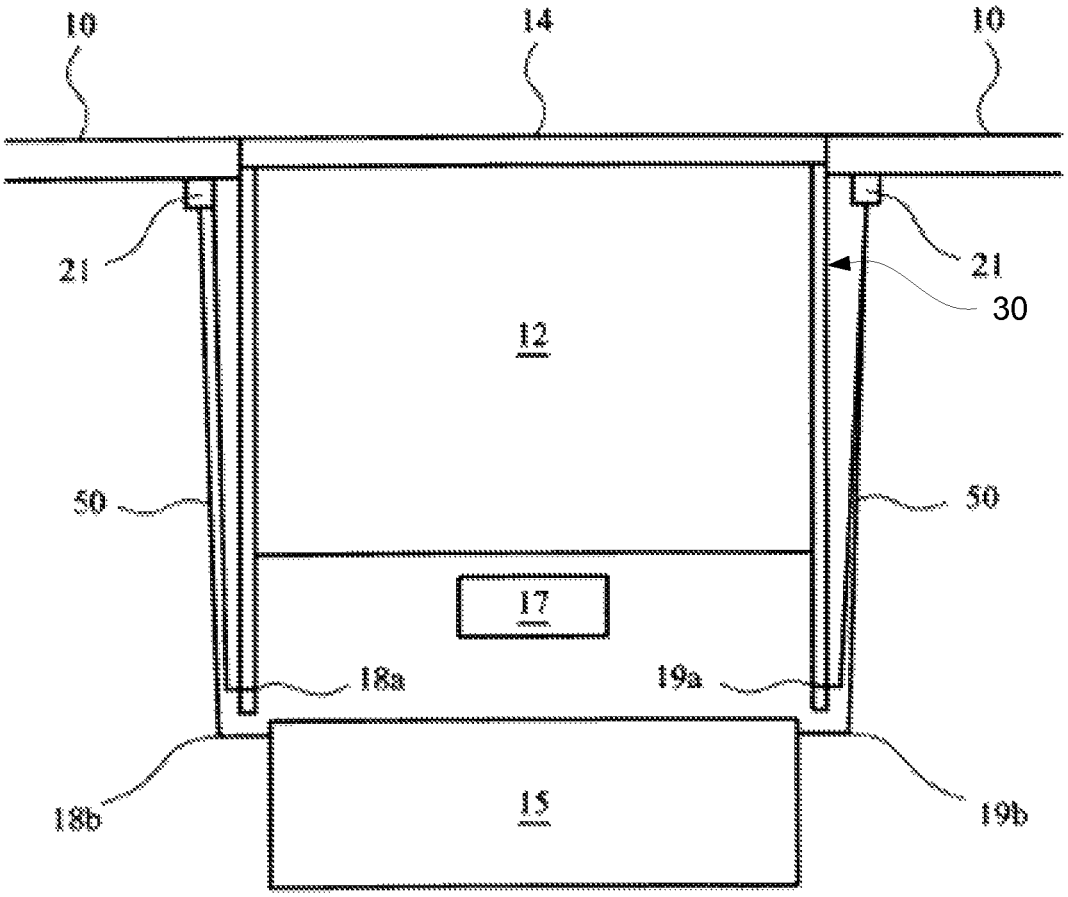

FIG. 4*a* is a schematic view of the front elevation of the unit with the storage unit (12) in its concealed position, showing the lifting pulleys (21), wire connections (50) counterweight (15), anchor points (18*a*), (18*b*), (19*a*), (19*b*) and latching mechanism (17).

Figure 4B:
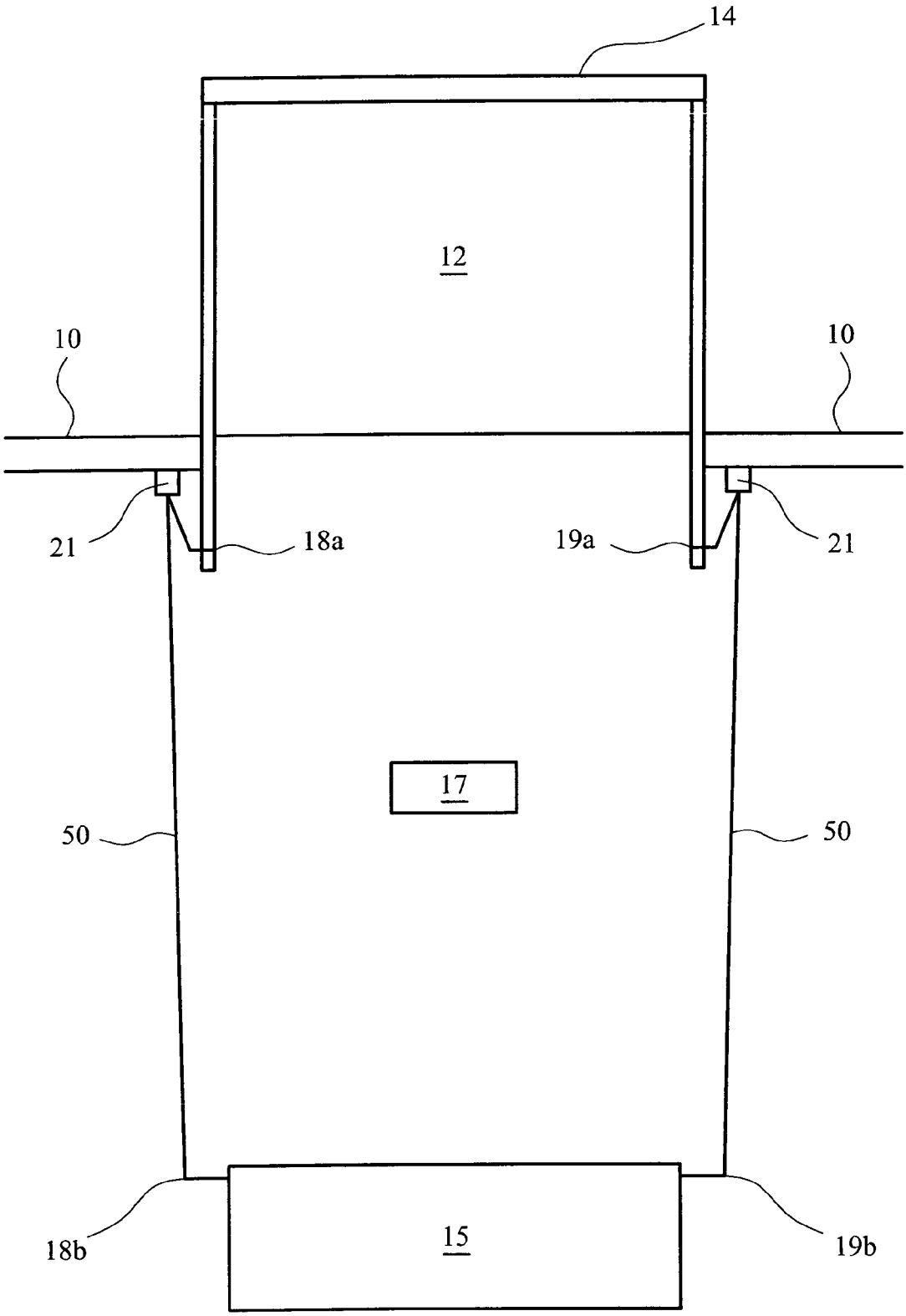

FIG. 4*b* is a schematic view of the front elevation of the unit with the storage unit (12) in its elevated position, showing the lifting pulleys (21), wire connections (50) counterweight location (15), anchor points (18), (18*b*), (19*a*), (19*b*) and latching mechanism (17).

Figure 5A:
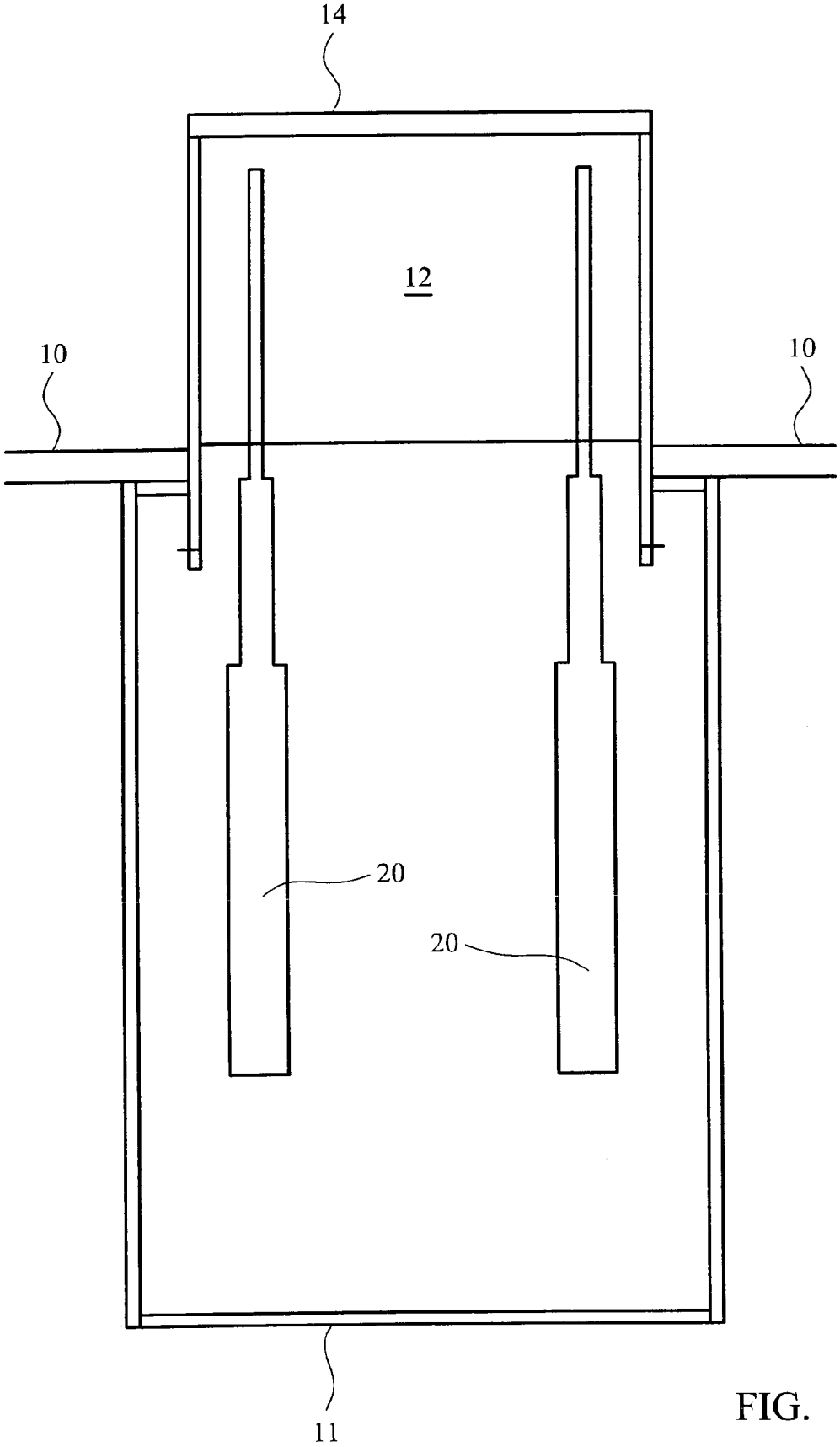

FIG. 5*a* is a schematic drawing of the rear of the storage unit (12) in a raised position, showing the housing guides (20) and their location in relation to the storage unit and unit housing (11).

Figure 5B:
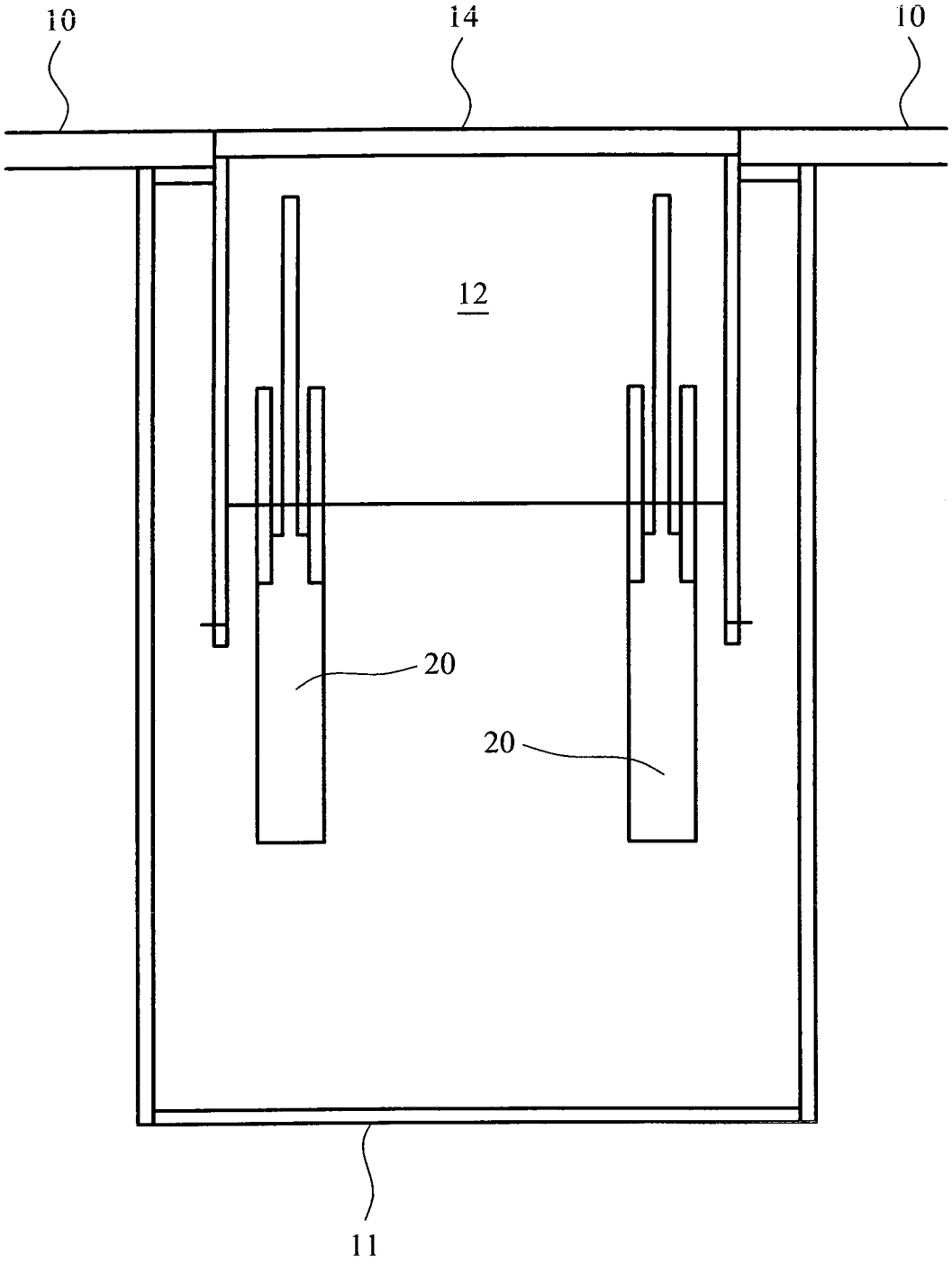

FIG. 5*b* is a schematic drawing of the rear of the storage unit (12) in a lowered position, showing the housing guides (20) and their location in relation to the storage unit and unit housing (11).

Figure 6:
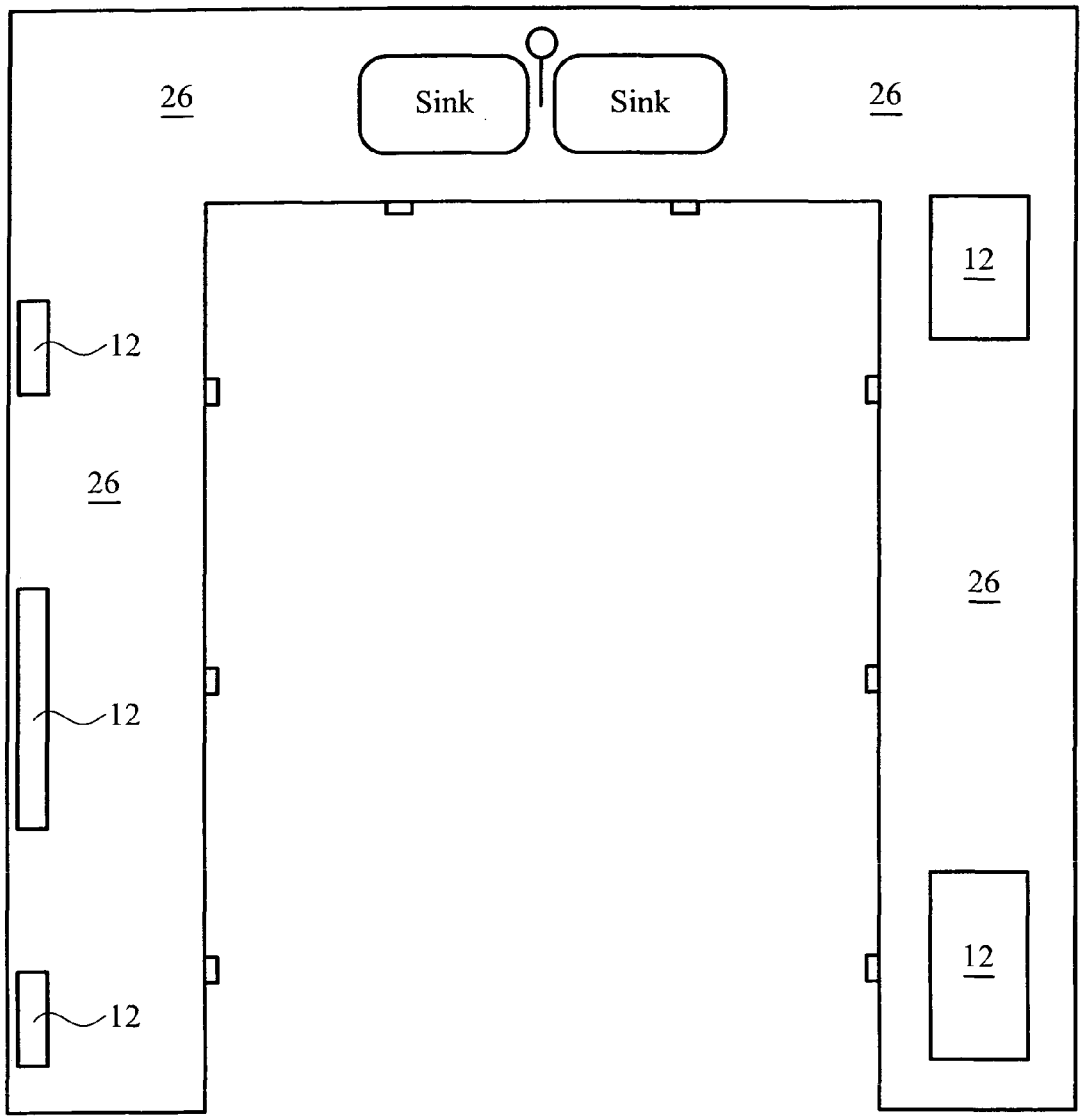

FIG. 6 is a plan view of a kitchen work surface within a home (26) showing the location of various storage units (12).

Figure 2:
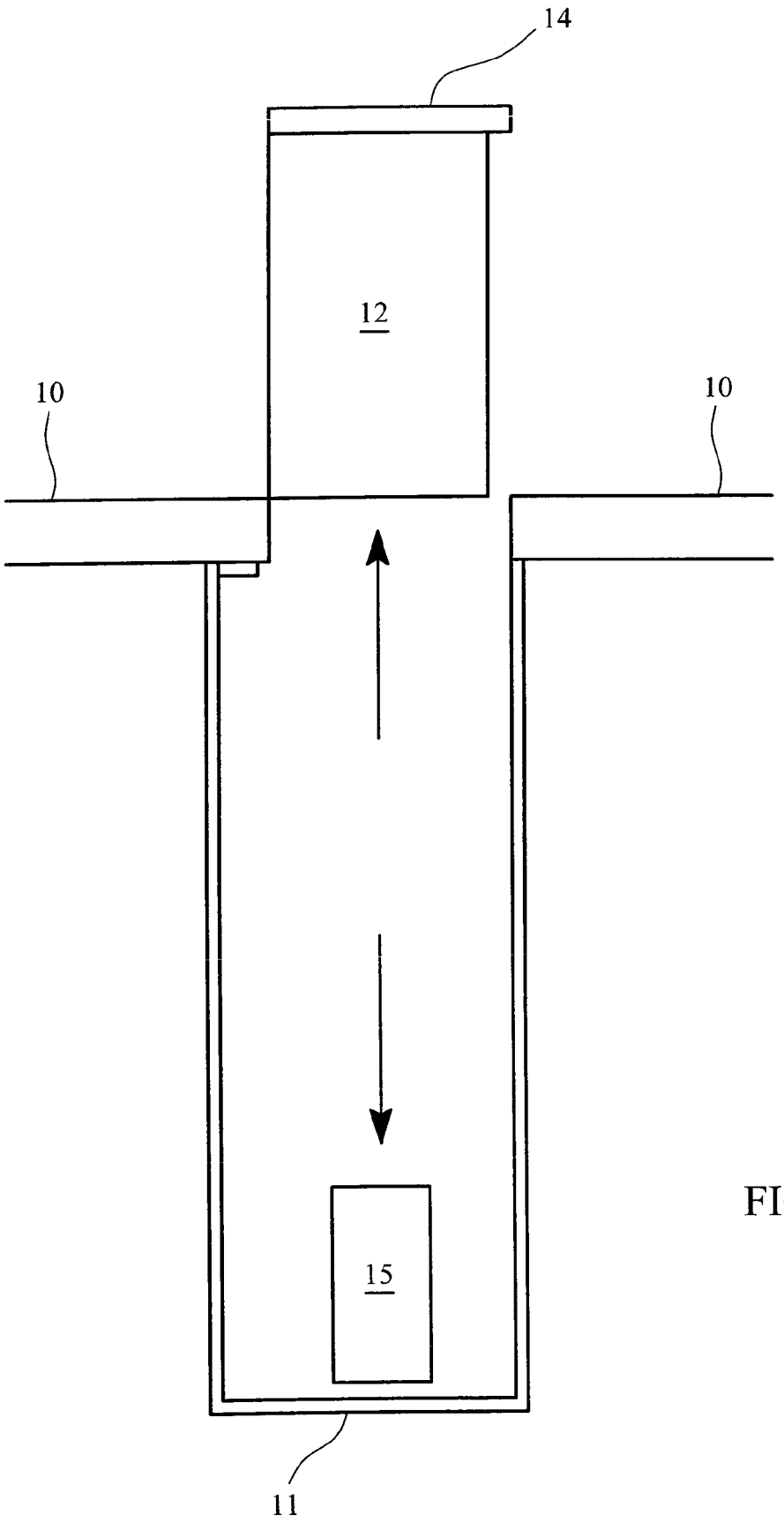
FIG. 2 is a similar view of a re-positioned top section (14) and a raised storage unit (12)
Figure 3:
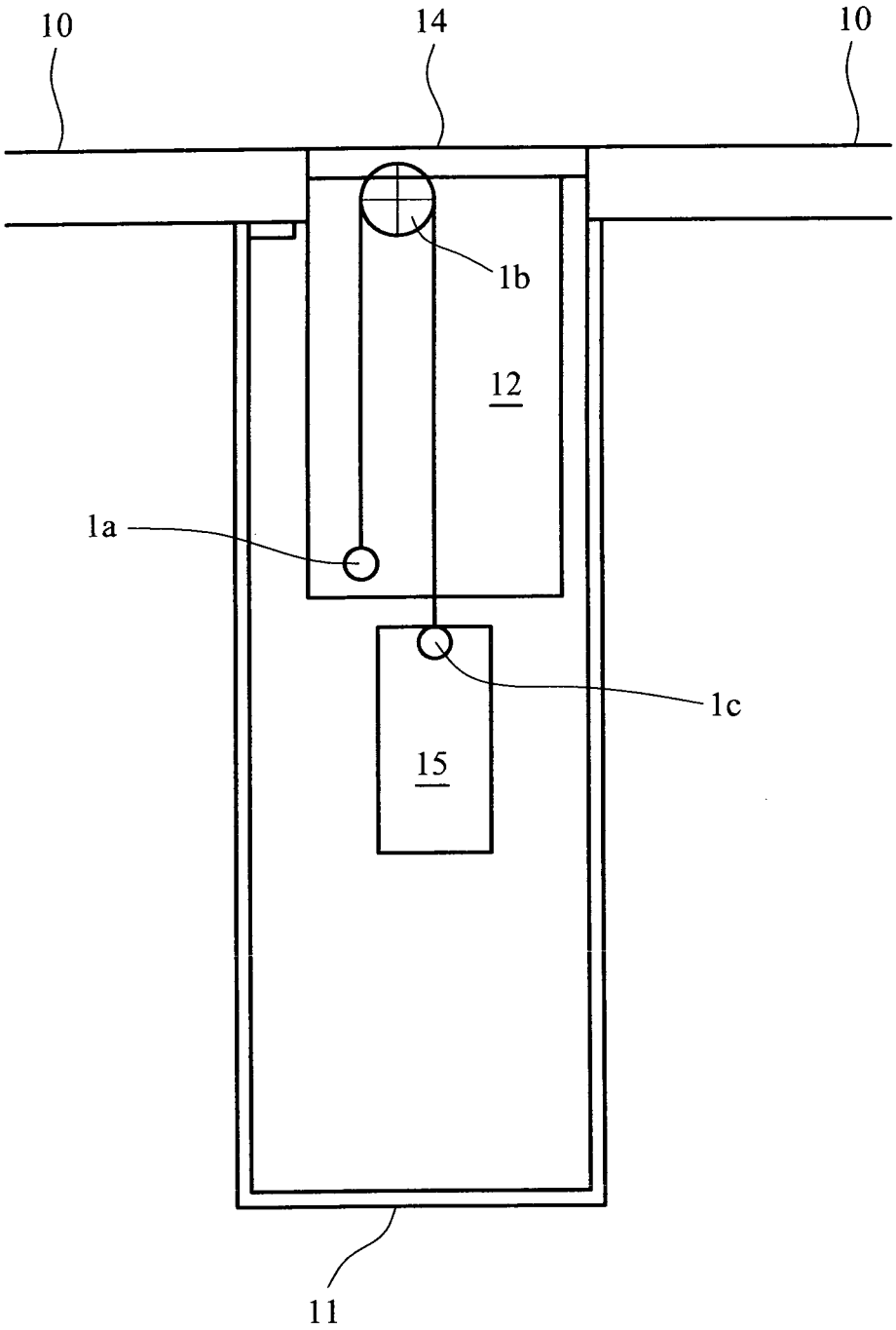
FIG. 3 is a schematic side view of the storage unit (12) showing the pulley system counter weight (15) and relative counterweight connection points (1*a*), (1*b*), and (1*c*)

The storage units (12) can be moved between the raised positions shown in FIGS. 2, 4*b* and 5*a* to a storage position in which they are flush with the adjacent surface (10). That surface could comprise any suitable work surface found within kitchens, bathrooms or offices, for instance. The lids (14) may have an upper surface corresponding with the adjacent surface (10), for instance the lid (14) may have a polished metal surface on it or it may have the same surface as its surrounding surface (10). In the storage position, the storage unit will be barely discernible if covered in the same surface as the surrounding surface.

Raising and lowering the storage unit is achieved by a plurality of pairs of links 18*a*, 18*b* and 19*a* and 19*b*. These links have predetermined weights placed upon them, the balance of which is in favour of the lowering counterweight thus causing the storage unit to raise vertically when in a free state, and be manually forced downwards to place it in its stored state.

A wire (50) has one end pivotally connected to the link (18*a*) and via a pulley the opposite end pivotally connected to (18*b*), likewise a second wire (50) has one end pivotally connected to the link (19*a*) and via a pulley the opposite end pivotally connected to (19*b*).

Figure 1:
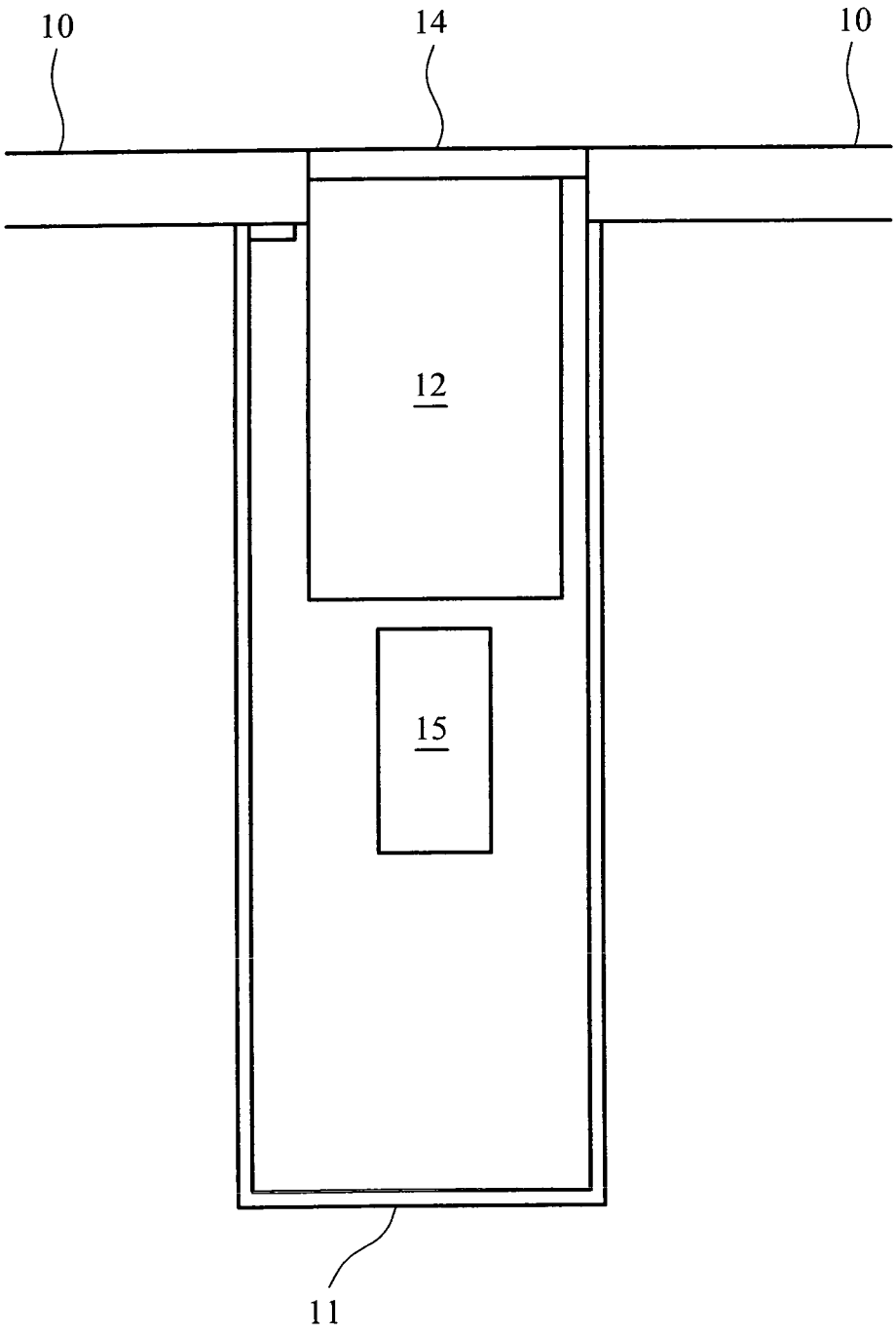
FIG. 1 is a schematic side view of a flat work surface (10), a stored storage unit (12) with its counterweight (15) and top section (14) in a lowered position located within an external housing (11)

In its retracted position of the stroke shown in FIG. 1 the storage unit is raised and held in the raised position due to the counterweight exerting more force upwardly than the storage unit and its contents are exerting downwardly. The counterweight is changing its force direction by way of one or two pulley systems.

So as to place the unit back in its storage position, manual pressure is applied to the lid (14) of the storage unit causing the unit to lower and the counterbalance to raise. The imbalance between the two opposing loads is kept to a minimum so as to achieve minimal manual pressure to be applied to lower the storage unit.

The counterweight (15) has the option to be manually altered by increasing or reducing its weight, thus the load held within the storage unit (12) can be accommodated whilst maintaining the relevant force to lift the storage unit and its contents.

Once the storage unit is in its lowered position it engages into a latch mechanism that holds it in its closed or stored state.

The latching mechanism (17) can be raised or lowered within predetermined parameters to accommodate the differing thicknesses of worktop (10), thus the stop and hold point of the top of the storage housing (14) can be set level with surrounding worktop or work surface (10).

Guides are provided to ensure aligned movement of the platform (30) when being raised or lowered or both.

A work surface is converted to have a storage unit by cutting out or removing the correct sized piece of work surface to accept the lid of the system through the work surface at the required location. Then the installer will need to clear the area below the work surface to pre determined dimensions so as to allow the complete system to be housed under the work surface, and be fixed to the underneath side of the work surface and at other points.

The top of the housing (14) can be adjusted to stop short of the adjacent work surface (10) to allow the depth of the work surface to be accommodated within the overall design, thus after installation the lid of the storage unit will be flush with the adjacent work surface.

In the event that there should be a mechanical failure to the system, means are provided for accessing the contents of the storage unit and mechanical components by way of a release panel in the main housing of the unit located under the work surface.

The closed and open storage unit may be of various sizes and may provide storage and transit for many varieties of products and equipment such as:

| | | |
|---|---|---|
| Microwave Oven | Spice Rack | Kitchen Utensil Rack |
| Knife Rack | Coffee Maker | Key Holder/Organiser |
| Remote Control Holder | Kitchen Cutlery | Mug Rack |
| Bread Bin | Wine Rack | LCD Television |
| Cold Storage | Bread Maker | Juicer |
| Liquidizer | Condiment Rack | Kettle |
| Kitchen Waste | MP3 Equipment | Sound Systems |
| Food | Kitchen Paperwork | Junk Zone Storage |
| Speakers | Games Consoles | Secure Storage |
| Kitchen Roll/Wipes | | |
| Hairdryer | Curling Tongs | Cosmetics |
| Perfumes | Cleaning Products | Toiletries |
| Shaving Equipment | Towels | Soaps |

-continued

| | | |
|---|---|---|
| Personal Grooming Equipment | Clothes | Night Clothes |
| Personal Hygiene Products | Bathroom Waste | Personal Possessions |
| Computer | Laptop | LCD Display |
| Office Waste | Paperwork | Filing |
| Other Computer Equipment | Personal Effects | Work Equipment |

The storage units may have light, power, water and computer connections supplied to and within them The plan area of the base of each storage unit may be up to 2 m in length and the surface area of the lid may be up to 2 m in length. A single platform or platform and base may be able to raise and lower a variety of storage units of varying weights having the variety of sizes in height or cross-section or both.

The weight of the counter weight may have a lifting capacity of up to 100 Kilograms for instance.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in the specification (including any accompanying claims, abstract and drawings), or to any noel one, or any novel combination, of the steps of any method or process so disclosed.

The invention claimed is:

1. A storage device adaptable to different thickness worktops having a storage unit for storing kitchen, office, or home appliances, provisions, or equipment and being movable between a raised position and a storage position in which, in the storage position, the storage unit is located within a housing and has a lid flush with an adjacent surface of the worktop, wherein:

the storage device comprises a driving means including a counterweight having a first weight and a pulley operable to move the storage unit between the storage position and the raised position;

the first weight of the counterweight is selected so that in use the counterweight and pulley arrangement exert a greater upward force on the storage unit than the storage unit exerts downwardly such that the storage unit moves toward the raised position when in a free state by the upward force of the counterweight and pulley arrangement alone;

the counterweight is configured to allow for manual alterations thereof so as to increase or decrease the first weight;

the storage unit further comprises guides configured to ensure aligned movement of the storage unit when moved between the raised position and the storage position within the housing;

the counterweight is arranged generally centrally beneath the storage unit when the storage unit is in the raised position and in the storage position;

the driving means and the storage unit are contained within the housing;

the storage unit includes a floor;

the floor of the storage unit, when the storage unit is in the in the raised position, is flush with the adjacent surface of the worktop; and the storage unit further comprises a latching mechanism having multiple latching positions, each said latching position corresponding to a different stop point for the storage unit such that each stop point permits a different thickness of a worktop to be accommodated such that the lid remains flush with the adjacent surface of the worktop in the storage position.

2. A storage device as claimed in claim 1 in which in the raised position, the storage unit is partly or wholly out of the housing.

3. A lid device as claimed in claim 1 in which the storage comprises a flat surface.

4. A storage device as claimed in claim 3 in which the lid of the storage unit is movable between a lowered position wherein the storage unit comprises a flat horizontal surface and a raised position wherein the storage unit comprises a flat horizontal surface.

5. A storage device as claimed in claim 1, wherein the storage unit includes a top surface and the housing includes a work surface, further wherein the top surface is terminated adjacent to the work surface.

6. A storage device as claimed in claim 1 in which the housing includes a base.

7. A storage device as claimed in claim 1, including a linkage arrangement connected to the driving means and arranged to raise the storage unit from the storage position to the raised position when the driving means are activated.

8. A storage device as claimed in claim 1, including a platform supporting the storage unit with the driving means being arranged to move the platform upwardly thereby moving the storage unit from the storage position to the raised position.

9. A storage device as claimed in claim 8, in which the drive means includes a lifting mechanism having at least one guide extending from a top region of the storage unit to a bottom region.

10. A storage device as claimed in claim 9 in which the guide of the lifting mechanism is connected to the platform.

11. A storage device as claimed in claim 1, in which, in the storage position, a top of the storage unit, in plan view, is side-by-side with the housing around a complete extent of the housing.

12. A storage device as claimed in claim 1 in which at least one side of the storage unit is substantially open or accessible.

13. A storage device as claimed in claim 1, wherein the storage unit is an enclosed storage unit.

14. A storage device as claimed in claim 1, comprising any one or more of an LCD TV, laptop, microwave, spice rack, utensil rack, kettle, knife block or rack, bread machine, fruit, cookies, paperwork, hairdryer, cosmetics, perfume, soaps.

15. A storage device as claimed in claim 1, wherein the storage unit includes an upper surface and the housing includes a work surface, further wherein the upper surface is of the same appearance as that of an adjacent surface portion of the work surface.

16. A storage device as claimed in claim 1, wherein the storage unit includes a top surface with marble or other work surface on top of the storage unit.

17. A storage device as claimed in claim 1, wherein the storage unit is operable to be fitted to a work surface by suspending the storage unit from said work surface.

* * * * *